US011952788B2

(12) United States Patent
Häfner et al.

(10) Patent No.: US 11,952,788 B2
(45) Date of Patent: Apr. 9, 2024

(54) ANGLED BOOM COMPRISING VARIABLE CROSS-SECTION FOR MOBILE CONCRETE PUMPS

(71) Applicant: Putzmeister Engineering GmbH, Aichtal (DE)

(72) Inventors: Jens Häfner, Stuttgart (DE); Peter Mögle, Leinfelden-Echterdingen (DE); Ansgar Müller, Stuttgart (DE); Knut Kasten, Ostfildern (DE)

(73) Assignee: Putzmeister Engineering GmbH, Aichtal (DE)

( * ) Notice: Subject to any disclaimer, the term of this patent is extended or adjusted under 35 U.S.C. 154(b) by 1184 days.

(21) Appl. No.: 16/612,852

(22) PCT Filed: May 9, 2018

(86) PCT No.: PCT/EP2018/062109

§ 371 (c)(1),
(2) Date: Nov. 12, 2019

(87) PCT Pub. No.: WO2018/206703

PCT Pub. Date: Nov. 15, 2018

(65) Prior Publication Data

US 2020/0199897 A1 Jun. 25, 2020

(30) Foreign Application Priority Data

May 12, 2017 (DE) ..... 10 2017 208 031.0

(51) Int. Cl.
*E04G 21/04* (2006.01)

(52) U.S. Cl.
CPC ..... *E04G 21/0436* (2013.01); *E04G 21/0445* (2013.01); *E04G 21/0427* (2013.01)

(58) Field of Classification Search
CPC . E04G 21/0436; E04G 21/04; E04G 21/0445; E04G 21/0427

(Continued)

(56) References Cited

U.S. PATENT DOCUMENTS 3,412,761 A * 11/1968 Verrell ..... F16L 59/029 138/153
3,685,543 A * 8/1972 Schwing ..... E04G 21/0436 137/351

(Continued)

FOREIGN PATENT DOCUMENTS

CN 102191862 A 9/2011
CN 103332610 A 10/2013

(Continued)

OTHER PUBLICATIONS

European Patent Office Communication from Examining Division for Application No. 18725450.3-1005 dated Nov. 10, 2020; 4 pgs.

(Continued)

*Primary Examiner* — Daphne M Barry
(74) *Attorney, Agent, or Firm* — Alix, Yale & Ristas, LLP

(57) ABSTRACT

The invention relates to a boom arm for mobile concrete pumps and to a mobile concrete pump. The boom arm, having a first and second end, wherein at least one elbowed section, in which the main bending loads which occur during proper use act as torsional loads, is provided between the first and the second end of the boom arm, is made from a fiber composite material, wherein beyond the elbowed region the height of the boom arm in cross-section is greater than the width of the boom arm in cross-section and in the elbowed region the width of the boom arm in cross-section is greater than or equal to the height of the boom arm in cross-section. A concrete pump with a placing boom, arranged on a substructure, comprising at least two boom (Continued)

arms, at least one of which is designed according to the invention.

19 Claims, 4 Drawing Sheets

(58) Field of Classification Search
USPC ..... 137/615
See application file for complete search history.

(56) References Cited

U.S. PATENT DOCUMENTS

| | | | | |
|---|---|---|---|---|
| 3,893,480 | A * | 7/1975 | Dunbar | B66C 13/12 137/355.17 |
| 4,171,597 | A * | 10/1979 | Lester | B66C 23/701 52/843 |
| 4,262,696 | A * | 4/1981 | Oury | E04G 21/04 141/232 |
| 5,238,716 | A * | 8/1993 | Adachi | B66F 11/044 428/36.1 |
| 6,586,084 | B1 * | 7/2003 | Paschke | B66C 23/701 442/232 |
| 6,719,009 | B1 * | 4/2004 | Bissen | E04G 21/0436 138/140 |
| 6,786,233 | B1 | 9/2004 | Anderson et al. | |
| 8,708,171 | B2 * | 4/2014 | Schmidt | B66C 23/905 212/347 |
| 10,662,609 | B2 * | 5/2020 | Hallale | E02F 3/382 |
| 10,697,148 | B2 * | 6/2020 | Hallale | B32B 3/08 |
| 10,806,105 | B2 * | 10/2020 | Murphy | B32B 3/20 |
| 11,447,967 | B2 * | 9/2022 | Mors | E04G 21/0445 |
| 2002/0117219 | A1 * | 8/2002 | Anderson | E04G 21/0436 137/615 |
| 2004/0069356 | A1 * | 4/2004 | Lehnhardt | E04G 21/04 137/615 |
| 2004/0108003 | A1 * | 6/2004 | Schwing | E04G 21/0418 137/615 |
| 2010/0230371 | A1 * | 9/2010 | Pirri | E04G 21/0436 212/347 |
| 2011/0220228 | A1 * | 9/2011 | Maini | E04G 21/0436 29/428 |
| 2013/0020274 | A1 * | 1/2013 | Munuswamy | B66C 23/80 212/347 |
| 2013/0078072 | A1 * | 3/2013 | Yelistratov | E04C 3/06 414/722 |
| 2015/0090850 | A1 * | 4/2015 | Maini | E02F 3/38 248/284.1 |
| 2015/0275532 | A1 * | 10/2015 | Fügel | E04G 21/0427 248/65 |
| 2017/0152668 | A1 | 6/2017 | Rau et al. | |
| 2017/0254101 | A1 * | 9/2017 | Segschneider | B66C 23/68 |
| 2018/0162701 | A1 * | 6/2018 | Henikl | B66C 13/46 |
| 2019/0316368 | A1 * | 10/2019 | Akkoc | B66C 23/64 |
| 2020/0080325 | A1 * | 3/2020 | Häfner | E04G 21/0445 |
| 2021/0047849 | A1 * | 2/2021 | Edler | E04G 21/0463 |

FOREIGN PATENT DOCUMENTS

| | | | |
|---|---|---|---|
| CN | 103352572 | A | 10/2013 |
| CN | 103332610 | B | 3/2016 |
| JP | H06313325 | A | 11/1994 |
| JP | 2005112514 | A | 4/2005 |
| KR | 20030048361 | A | 6/2003 |
| WO | 2014019887 | A1 | 2/2014 |
| WO | 2016023758 | A1 | 2/2016 |

OTHER PUBLICATIONS

"Mechanics of Materials"; Engineering Mechanics Course, vol. Three; Jan. 14, 2021; Zhilun et al.; Publication date: Mar. 31, 1953; 15 pgs.

Chinese Search Report for Application No. 2018800312368 filed May 9, 2018; dated: Jan. 14, 2021; 2 pgs.

International Search Report for International application No. PCT/EP2018/062109; dated Aug. 23, 2018; 2 pgs.

* cited by examiner

ANGLED BOOM COMPRISING VARIABLE CROSS-SECTION FOR MOBILE CONCRETE PUMPS

BACKGROUND

The invention relates to a boom arm for mobile concrete pumps and to a mobile concrete pump.

Mobile concrete pumps usually have a boom arm, arranged on a movable substructure, with a delivery pipe running along it through which the flowable concrete can be pumped. The boom arm here comprises multiple booms which can be pivoted relative to one another about pivot axes in each case transversely to the longitudinal direction of the boom arm.

It is consequently possible in principle to fold together the boom in such a way that, together with the movable substructure, it does not exceed a predetermined maximum height. The predetermined maximum height can here correspond, for example, to customary clearance heights for road traffic and hence the mobile concrete pump can also travel under bridges and through tunnels.

In order to be able to fold together the boom so that it is as small as possible and hence achieve the highest possible number of boom arms, it is known that individual boom arms are configured so that they are elbowed. As a result, when folded together about the described pivot axes, the boom arms can lie partially next to one another such that the set of folded-together boom arms has a lower height than a corresponding set of folded-down boom arms where none of the boom arms are elbowed.

Elbowed boom arms manufactured from steel are known from the prior art. In the case of these boom arms, a plurality of steel profiles having the same cross-section are welded to one another in such a way that the desired elbow results, wherein when elbowed two steel profiles are arranged essentially parallel to each other and are connected to each other by a third steel profile which extends at an angle to them.

In order to absorb the forces acting on the boom arm during operation and in order to be able to produce the elbow by means of welding, the steel profile must have a certain wall thickness. An elbowed boom arm according to the prior art consequently has a not inconsiderable weight.

In particular because the number of possible boom arms of a mobile concrete pump—and hence often the maximum height that can be obtained—is often limited by the maximum permissible total weight of the concrete pump or alternatively by its maximum permissible axle load, the high weight of the individual boom arms and in particular the elbowed boom arms according to the prior art is a disadvantage.

SUMMARY OF THE INVENTION

The object of the invention is to provide an elbowed boom arm and a mobile concrete pump in which the disadvantages from the prior art no longer pertain or only to a reduced extent.

This object is achieved by a boom arm as claimed in the main claim and a mobile concrete pump as claimed in the subordinate claim 12. Advantageous developments are the subject of the dependent claims.

The invention accordingly relates to a boom arm, in particular for the placing boom of a concrete pump, having a first and second end, wherein at least one elbowed section, in which the main bending loads which occur during proper use act as torsional loads, is provided between the first and the second end of the boom arm, and the boom arm is made from a fiber composite material, wherein beyond the elbowed region the height of the boom arm in cross-section is greater than the width of the boom arm in cross-section and in the elbowed region the width of the boom arm in cross-section is greater than or equal to the height of the boom arm in cross-section.

The invention furthermore relates to a concrete pump with a placing boom arranged on a substructure and comprising at least two boom arms, wherein at least one boom arm is designed according to the invention.

Some terms used in connection with the invention are first explained:

The terms "width" and "height" of the boom arm refer to the dimensions of the boom arm as are defined for calculating the geometrical moment of inertia about a pivot axis of the boom arm. A pivot axis of the boom arm is here an axis about which the boom arm can be pivoted directly with respect to an adjacent boom arm, relative to the latter.

In the case of a "continuous fiber-reinforced fiber composite material", the fibers or continuous fibers have a length which is generally greater than 50 mm. The fiber length is in particular such that they can no longer be processed in an extrusion method. Instead, corresponding continuous fibers are generally available as a flat raw material or roving which can then be processed to produce a fiber composite material. "Roving" here designates a bundle, strand, or multi-filament yarn consisting of continuous fibers arranged essentially in parallel. A "flat raw material" can be, for example, a woven fabric, nonwoven fabric, knitted fabric, or plaited fabric.

Owing to the fact that the boom arm according to the invention is produced from fiber composite material, a saving in weight can in principle be achieved compared with a comparable steel boom arm. By virtue of the significantly lower specific weight of fiber composite material, a significant reduction in weight compared with the steel construction can be achieved, even when a slightly larger wall thickness may have to be chosen in order to obtain a comparable stiffness.

Although a corresponding change of material may in principle be possible in particular in the case of non-elbowed boom arms while maintaining the shape, the invention is based on the recognition that, at least in the case of elbowed boom arms, it is not readily possible to correspondingly replace the material easily or at least does not afford any greater saving in weight. This is explained inter alia by the fact that, in the case of elbowed boom arms made of fiber composite material, the wall thickness cannot be significantly reduced compared with a steel design without the stiffness of the boom arm being reduced in the region of the elbow to a value which is not acceptable for use in concrete pumps.

The invention has recognized that, in the region of the elbow, some of the normal loads which act on the boom arm, which are originally bending loads, act as torsional loads. Based on this recognition, the invention provides that this particular form of loading in the region of the elbow is counteracted not by a greater wall thickness but instead by a shape which is adapted to the loading. Whilst the height of the boom arm in cross-section beyond the elbowed region is greater than the width of the boom arm in cross-section—as a result of which in particular bending loads can be absorbed well—in the elbowed region the width of the boom arm in cross-section is greater than or equal to the height of the boom arm in cross-section. As a result of the adaptation of the cross-section according to the invention, a sufficient stiffness can often be readily obtained also in the region of the elbow without there being any need to increase the wall thickness.

It follows directly from the described connection between the bending load of the boom arm as a whole and the resulting torsional load in the region of the elbow that the boom arm is elbowed in a plane perpendicular to the bending load. Only in this case do the problematic torsional loads occur. In particular, the boom arm can be elbowed in a plane which extends parallel to at least one of the pivot axes about which the boom arm can in each case be pivoted relative to an adjacent boom arm. In the case of a corresponding elbow, it is possible, as is known from the prior art, to lay boom arms side by side when a boom is folded together.

It is instead preferred if the wall thickness in the region of the elbow is smaller or essentially the same as the wall thickness beyond the elbow.

The height of the boom arm in cross-section in the region of the elbow is preferably the same as the height of the boom arm in cross-section beyond the elbow, wherein this height, for reasons of stiffness, often corresponds to the maximum available structural height for the boom arm. Because the height is the same over the whole length of the boom arm, it is ensured that the bending loads acting on the boom arm are absorbed uniformly over its whole length.

The latter also applies if the height of the boom arm tapers from one end to the other end and the height at one end is therefore greater than at the other end. In this case, it is preferred if the height of the boom arm in cross-section tapers uniformly over the region of the elbow. It is in particular intended to dispense with a stepwise modification of the height.

It is preferred if the transition between the cross-section of the boom arm beyond the elbowed region and the cross-section of the boom arm in the elbowed region is a smooth one such that no additional notch effect occurs as a result of the transition. By virtue of a corresponding transition, additional loads are therefore avoided on the fiber composite material which could occur in principle owing to the unfavorable shape of the boom arm.

It is preferred if the cross-section of the boom arm in the elbowed region is based on an essentially octagonal base with a p4 symmetry, wherein the edges which form the axes of symmetry are preferably larger than the other edges and/or the edges which run in the direction of the width of the cross-section are longer than the edges which run in the direction of the height of the cross-section. By virtue of a corresponding shape, the bending and torsional loads which occur in the elbowed region can be readily absorbed.

The cross-section of the boom arm beyond the elbowed region is preferably based on an essentially octagonal base with a p4 symmetry, wherein the edges which form the axes of symmetry are preferably larger than the other edges and/or the edges which run in the direction of the height of the cross-section are longer than the edges which run in the direction of the width of the cross-section. The cross-section is optimized because the bending loads dominate in the region beyond the elbow.

It is preferred if the cross-section of at least some of the edges of the boom arm is curved convexly outward, it being possible for this to apply both to the region of the elbow and to the region beyond the latter. The torsional stiffness of the boom arm can be increased by a corresponding partially convex shape.

It is preferred if the corners in the cross-section of the boom arm are rounded. Stress peaks can be avoided or at least reduced by correspondingly rounded corners.

The boom arm preferably has at least one through opening as an articulation point, wherein the opposite regions of the outer surfaces of the boom arm, into which one of the through openings opens, are each configured so that they are parallel to each other. Because the outer surfaces are arranged parallel to each other in the region of a corresponding through opening through which, for example, a hinge bolt can be guided, the attachment of the boom arm according to the invention to other components such as, for example, a further boom arm is facilitated.

The boom arm is preferably made from endless fiber-reinforced fiber composite material and can be formed from a fibrous nonwoven fabric, a fibrous woven fabric, a fibrous plaited fabric, or a combination thereof. In particular in the case of a fibrous nonwoven fabric, it is possible to place the individual fibers or rovings in an optimized fashion in a shape for the boom arm. It is also possible to use specially produced nonwoven preforms where the individual fibers are fastened, for example by being sewn, on a woven substrate in the desired process.

It is also possible for the boom arm to be produced from prefabricated mats by lamination. The fibers can here be arranged differently. An essentially quasi isotropic arrangement of ±0°/+45°/±90°/−45° or ±0°/+30°/+60°/±90°/−60°/−30° is thus possible. The layers can here be laminated individually or in the form of a prefabricated multi-layer nonwoven fabric. It is also possible to use a unidirectional nonwoven fabric which is laid in a shape for the boom arm which corresponds to the loads which are to be expected.

Suitable methods are known from the prior art for introducing the matrix during or after the laying of the fibers. The fibers can thus be positioned in a wet form (i.e. impregnated with the matrix material), dry form (with subsequent introduction of the matrix material), or in the form of prepregs (fibers impregnated with thermosetting matrix material). A resin, preferably epoxy resin, can be used in particular as the matrix material.

It can also be provided that a core material is provided at least in some regions of the boom arm between two layers of fiber composite material to form a sandwich structure. The core material can be made, for example, from balsa wood or foam.

Reference is made to the above embodiments for an explanation of the concrete pump according to the invention.

BRIEF DESCRIPTION OF THE DRAWINGS

The invention is now described by way of example with the aid of an advantageous embodiment with reference to the attached drawings, in which.

DETAILED DESCRIPTION

Figure 1:
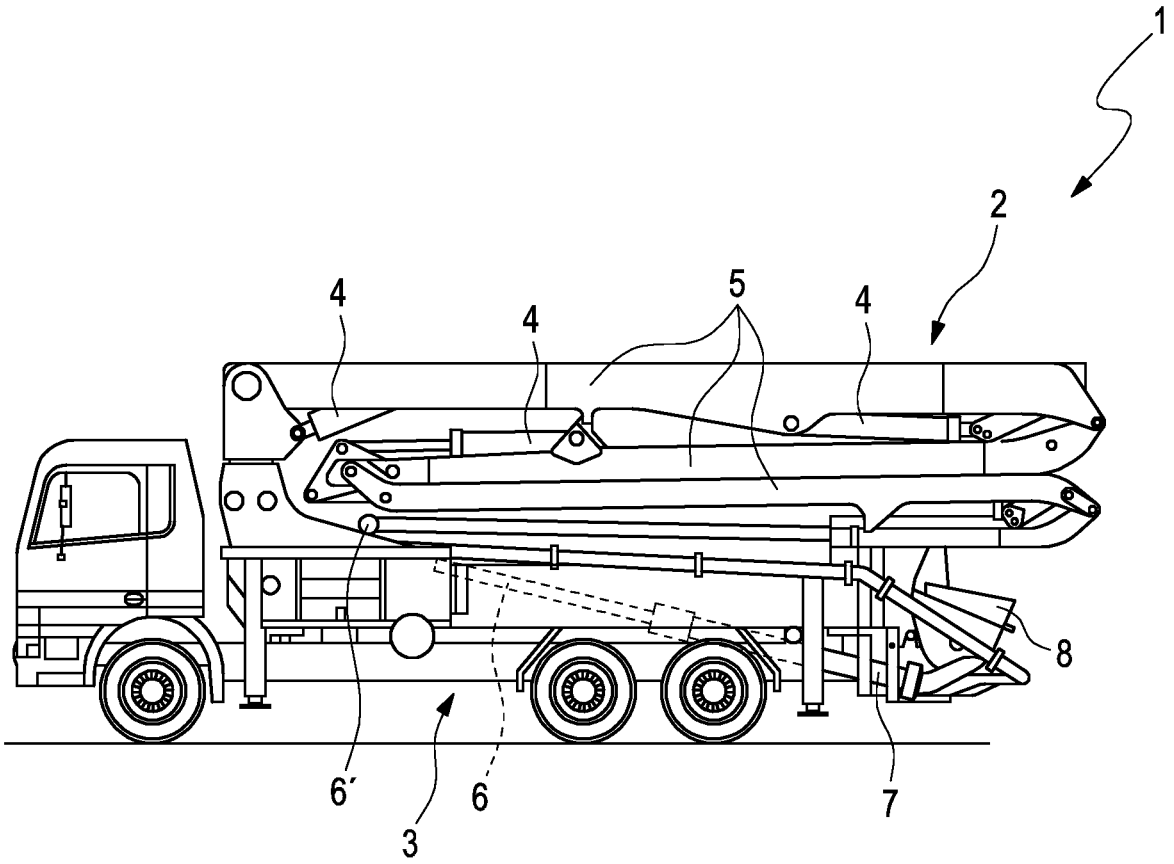
FIG. 1: shows an exemplary embodiment of a mobile concrete pump according to the invention.

The mobile concrete pump 1 with a placing boom 2 shown in FIG. 1 is a truck-mounted concrete pump in which the placing boom 2 is fastened on a movable substructure 3. The placing boom 2 can be folded up and for this purpose comprises a plurality of boom arms 5, which can be pivoted relative to one another by hydraulic cylinders 4, inside which passes a delivery pipe 6 (only part of which is shown) for flowable concrete. Flowable concrete can be delivered with the aid of a core pump 7 arranged on the substructure 3 from the feed hopper 8 through the delivery pipe 6 to the free open end 6' of the delivery pipe 6.

Figure 2:
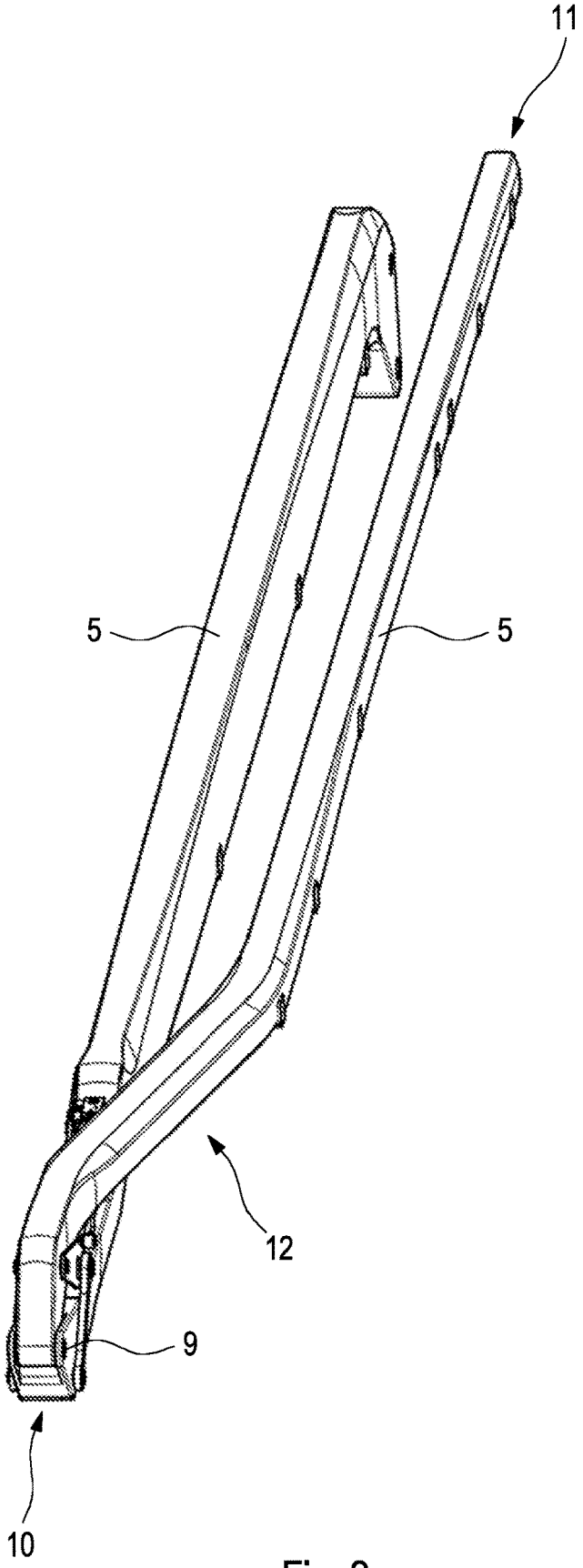
FIG. 2: shows a detailed view of two boom arms of the concrete pump from FIG. 1.

Two of the boom arms 5 of the concrete pump 1 from FIG. 1 are shown individually in FIG. 2, wherein one of the two boom arms 5 is elbowed and at least the elbowed boom arm 5 is made from continuous fiber-reinforced fiber composite material. The two boom arms 5 are connected so that they can pivot relative to each other via a hinge bolt 9.

The elbowed boom arm 5 in FIG. 2 comprises an elbowed region 12 arranged between the first end 10 and the second end 11 of the boom arm 5, wherein the elbow lies in a plane parallel to the hinge bolt 9 and the pivot axis defined thereby. A cross-section through the boom arm 5 in the elbowed region is shown in FIG. 3, whilst a cross-section through the same boom arm 5 is shown in FIG. 4 but beyond the elbowed region 12.

Figure 3:
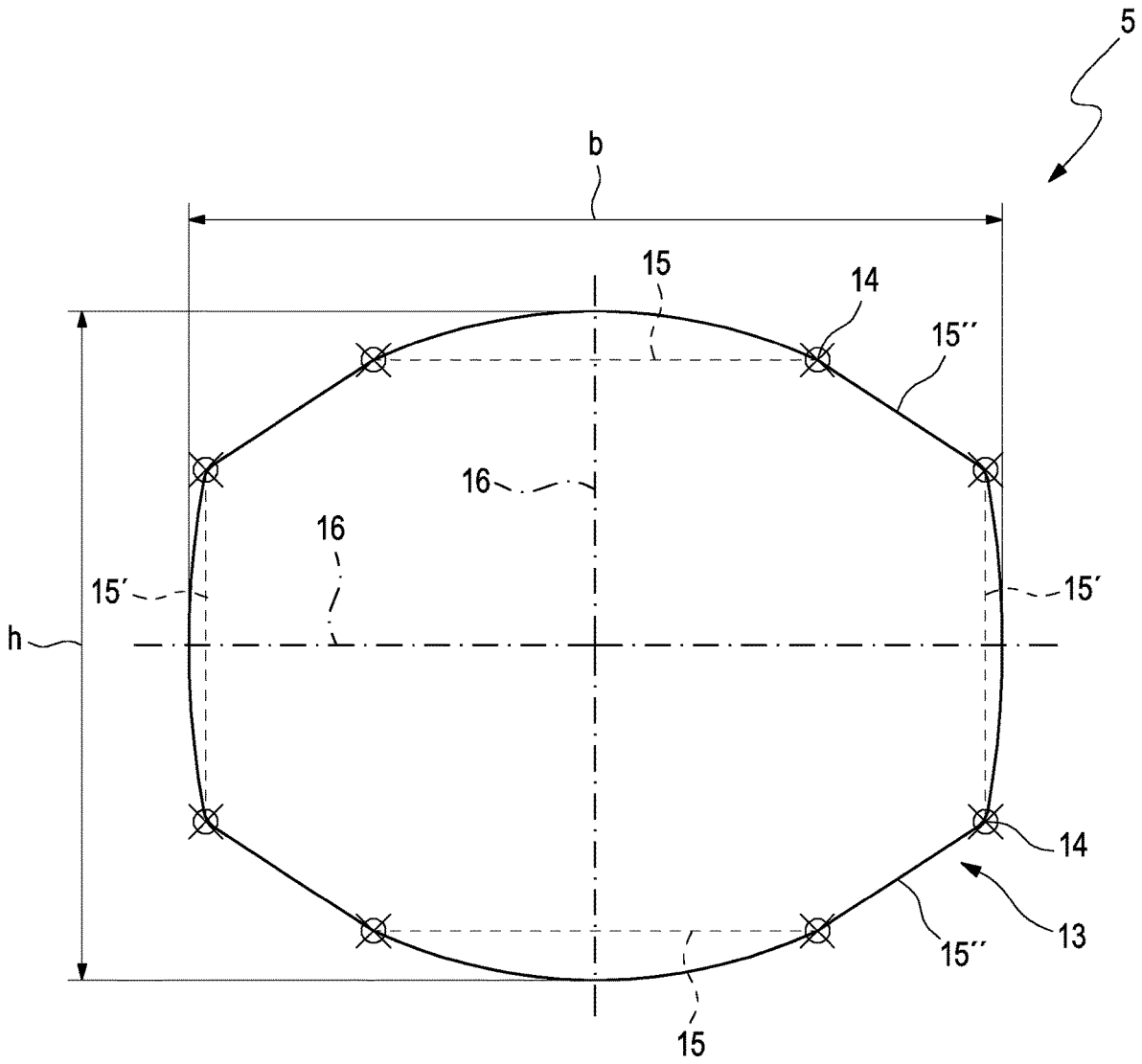
FIG. 3: shows a cross-section through the elbowed boom arm from FIG. 2 in the region of the elbow.
Figure 4:
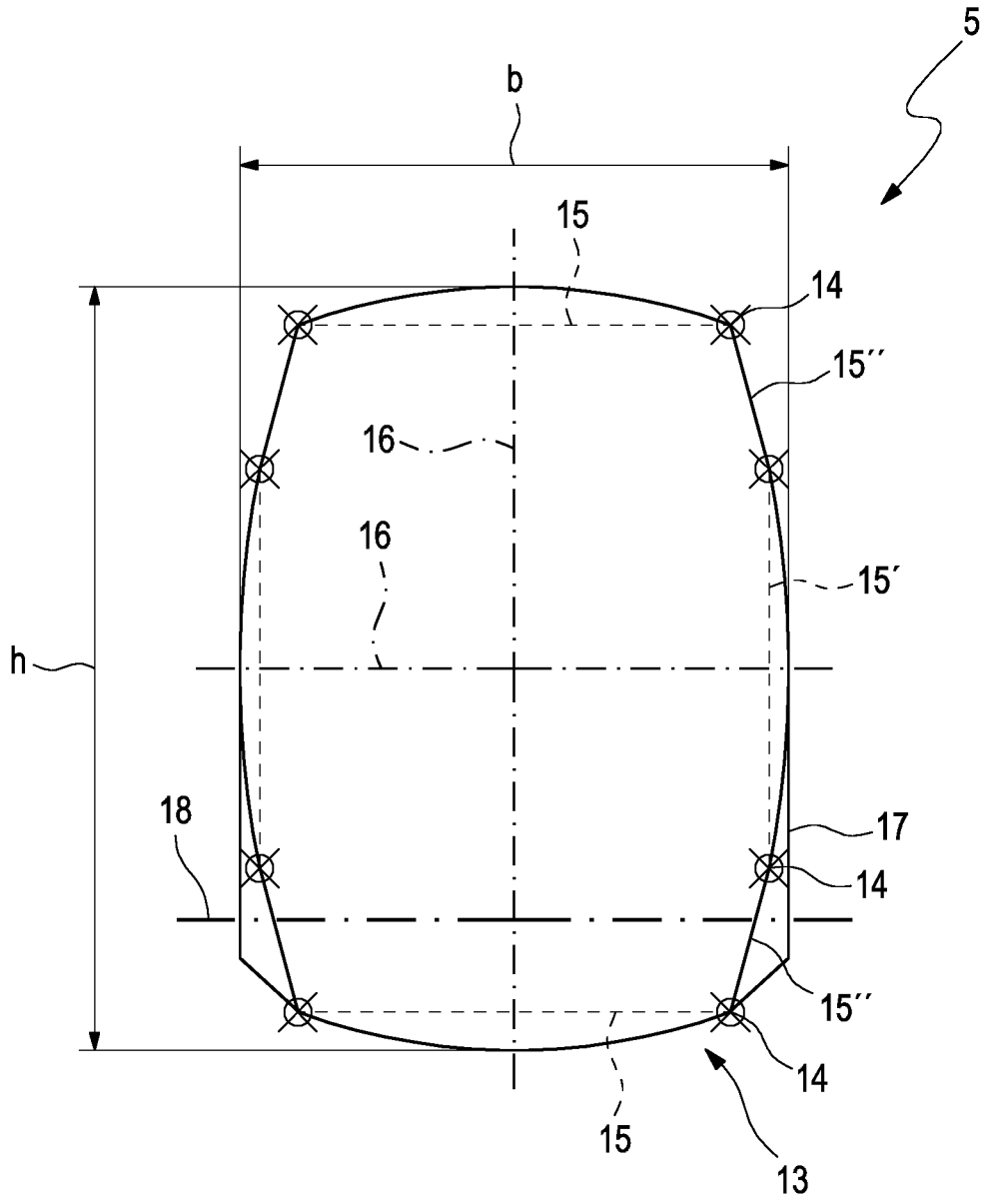
FIG. 4: shows a cross-section through the elbowed boom arm from FIG. 2 in the region beyond the elbow.

As shown in FIGS. 3 and 4, both cross-sections are based on an octagonal base 13 with edges 15, 15', 15" shown in each case as dashed lines and corners 14 indicated by marks and, with the aid of the axes of symmetry 16 shown as dot-dash lines, in each case have a p4 symmetry. Those edges 15, 15' which are used to form the axes of symmetry 16 are here longer than the edges 15" which do not intersect any axes of symmetry 16.

As can be seen directly in FIG. 3, in the region of the elbow 12 in cross-section those edges 15 which extend in the direction of the width b are longer than those edges 15' which extend in the direction of the height h. The opposite applies beyond the elbow. As can be seen in FIG. 4, those edges 15' which extend in the direction of the height h are longer there than the edges 15 which extend in the direction of the width b.

The boom arm 5 is curved convexly outward at the edges 15, 15' of the boom arm 5 both in the region of the elbow 12 (cf FIG. 3) and beyond it (cf FIG. 4). The curvature is here configured such that the boom arm 5 has a constant height h over its whole length. The upper side of the boom arm 5, visible in FIG. 2, accordingly has no step in it. It can likewise be seen in FIG. 2 that the transition from the cross-section of the boom arm 5 in the elbowed region 12 to the cross-section beyond this region 12 is smooth such that no additional notch effect occurs as a result of the change in cross-section. Furthermore, in order to avoid other possible stress peaks, the boom arm 5 is rounded in cross-section at the corners 14 (cf FIGS. 3 and 4).

It is moreover shown in FIG. 4 that the boom arm 5 is widened outward in certain regions in such a way that two opposite parallel outer surfaces 17 result. A through opening 18 (only the axis of which is shown), for example for the passage of the hinge bolt 9 (cf FIG. 2), is provided on these parallel outer surfaces 17. Corresponding outer surfaces 17 can also be provided in regions of other through openings 18.

The boom arm 5 is manufactured in one piece from continuous fiber-reinforced fiber composite material, wherein the boom arm 5 is laminated from prefabricated mats using known methods. Over the whole length of the boom arm 5, the number of the mats for creating the structure is here constant, viewed over the cross-section. Consequently, the cross-sectional area also remains constant over the whole length of the boom arm 5. However, because the cross-section of the boom arm 5 in the region of the elbow 12 (cf FIG. 3) has a larger circumference than outside this region (cf FIG. 4), the wall thickness in the region of the elbow 12 is slightly reduced in individual part regions in order moreover to obtain this same cross-sectional area.

The invention claimed is:

1. A boom arm (5) for a placing boom (2) for a concrete pump (1):

said boom arm (5) made from a fiber composite material, said boom arm (5) having a first end (10) and a second end (11) and an elbowed section (12) between the first and second ends (10, 11), said elbowed section (12) is angled relative to an axis of the boom arm (5) between the elbowed section (12) and the second end (11) of the boom arm (5), wherein said boom arm has a first cross-section in the elbowed section (12), said first cross-section having a width (b) greater than or equal to a height (h), and a second cross-section outside of the elbowed section (12) having a height (h) greater than a width (b), the first and second cross sections are based on an octagon having p4 symmetry and at least some of the sides of the boom arm are curved convexly outward.

2. The boom arm of claim 1, wherein the cross-section of the boom arm (5) transitions gradually from the first cross-section to the second cross-section.

3. The boom arm of claim 1, wherein the octagon on which the first cross-section is based having a first axis of symmetry in a direction of the height (h) of the cross section, and a second axis of symmetry in a direction of the width (b) of the cross section, the sides (15, 15') of the octagon intersecting with the first and second axis of symmetry being longer than the sides (15") of the octagon not intersecting with the first and second axis of symmetry.

4. The boom arm of claim 1, wherein the octagon having a first axis of symmetry in a direction of the height (h) of the cross section, and a second axis of symmetry in a direction of the width (b) of the cross section, the sides (15) of the octagon intersecting with the first axis of symmetry being longer than the sides (15') of the octagon intersecting with the second axis of symmetry.

5. The boom arm of claim 1, wherein the octagon on which the second cross-section is based having a first axis of symmetry in a direction of the height (h) of the cross section, and a second axis of symmetry in a direction of the width (b) of the cross section, the sides (15, 15') of the octagon intersecting with the first and second axis of symmetry being longer than the sides of the octagon (15") not intersecting with the first and second axis of symmetry.

6. The boom arm of claim 1, wherein the octagon on which the second cross-section is based having a first axis of symmetry in a direction of the height (h) of the cross section, and a second axis of symmetry in a direction of the width (b) of the cross section, the sides (15') of the octagon intersecting with the second axis of symmetry being longer than the sides (15) of the octagon intersecting with the first axis of symmetry.

7. The boom arm of claim 1, wherein the second end (10) is offset from the first end (11) of the boom arm (5) in a direction corresponding to the height (h) of the first and second cross-sections.

8. The boom arm of claim 1, wherein the corners formed by an intersection of the sides (15, 15', 15") of the octagon are rounded.

9. The boom arm of claim 1, wherein the boom arm (5) includes at least one through opening (18) as an articulation point, wherein outer surfaces (17) of the boom arm (5) surrounding the through opening (18) are parallel to each other.

10. The boom arm of claim 1, wherein a wall of said boom arm (5) has a first wall thickness in said elbowed section (12) and a second wall thickness outside of said elbowed section (12), said first wall thickness being equal to the second wall thickness.

11. The boom arm of claim 1, wherein a wall of said boom arm (5) has a first cross-sectional area in the elbowed section (12) and a second cross-sectional area outside of said elbowed section (12), wherein the first cross-sectional area is the same as the second cross-sectional area.

12. The boom arm of claim 1, wherein the height (h) of the first cross section is the same as the height (h) of the second cross section.

13. The boom arm of claim 1, wherein the height (h) of the boom arm (5) tapers uniformly from the first end (10) to the second end (11), including over the elbowed section (12).

14. The boom arm of claim 1, wherein said boom arm (5) is made from a continuous fiber-reinforced fiber composite material.

15. The boom arm of claim 1, wherein said first cross-section is based on an irregular octagon, and second cross-section is based on an irregular octagon.

16. A concrete pump (1) with a placing boom (2) arranged on a substructure (3) and comprising at least two boom arms (5), wherein at least one of the boom arms (5) is a boom arm of claim 1.

17. The boom arm of claim 1, wherein a wall of said boom arm (5) has a first wall thickness in said elbowed section (12) and a second wall thickness outside of said elbowed section (12), said first wall thickness being less than the second wall thickness.

18. The boom arm of claim 1, wherein the cross-sectional area occupied by a wall of the boom is constant over the length of the boom, with a wall thickness of the boom in the elbowed section (12) being less than a wall thickness of the boom outside of the elbowed section (12).

19. A boom arm (5) for a placing boom (2) for a concrete pump (1):

said boom arm (5) made from a fiber composite material, said boom arm (5) having a first end (10) and a second end (11) and an elbowed section (12) between the first and second ends (10, 11), said elbowed section (12) being angled relative to an axis of the boom arm (5) between the elbowed section (12) and the second end (11) of the boom arm (5), wherein said boom arm has a first cross-section in the elbowed section (12), said first cross-section having a width (b) greater than or equal to a height (h), and a second cross-section outside of the elbowed section (12) having a height (h) greater than a width (b), the first or second cross sections are based on an octagon having p4 symmetry and at least some of the sides of the boom arm are curved convexly outward.

* * * * *